US005725681A

United States Patent [19]

Ishitobi et al.

[11] Patent Number: 5,725,681

[45] Date of Patent: Mar. 10, 1998

[54] PROCESS FOR PRODUCING GRAIN ORIENTED SILICON STEEL SHEET, AND DECARBURIZED SHEET

[75] Inventors: Hirotake Ishitobi; Takafumi Suzuki; Michiro Komatsubara; Hiroi Yamaguchi, all of Okayama, Japan

[73] Assignee: Kawasaki Steel Corporation, Japan

[21] Appl. No.: 707,122

[22] Filed: Sep. 3, 1996

[30] Foreign Application Priority Data

Sep. 7, 1995 [JP] Japan ..... 7-230103

[51] Int. Cl.[6] ..... H01F 1/14

[52] U.S. Cl. ..... 148/113; 148/122

[58] Field of Search ..... 148/113, 122

[56] References Cited

U.S. PATENT DOCUMENTS

| | | | |
|---|---|---|---|
| 4,268,326 | 5/1981 | Iwayama et al. | 148/111 |
| 4,576,658 | 3/1986 | Inokuti et al. | 148/113 |
| 5,082,509 | 1/1992 | Yoshiyuki et al. | 148/113 |
| 5,269,853 | 12/1993 | Komatsubara et al. | 148/113 |
| 5,571,342 | 11/1996 | Komatsubara et al. | 148/113 |
| 5,620,533 | 4/1997 | Kotani et al. | 148/113 |

*Primary Examiner*—John Sheehan
*Attorney, Agent, or Firm*—Austin R. Miller

[57] ABSTRACT

Producing a grain oriented silicon steel sheet by controlling physical properties of the oxides layer, formed in decarburization annealing, in the surface layer of a steel sheet. A silicon compound is adhered to the surface of steel sheet before the decarburization annealing in an amount ranging from about 0.5 to 7.0 mg per square meter, expressed as Si, and the atmosphere of an earlier portion of the temperature holding process is adjusted to a ratio of steam partial pressure to the hydrogen partial pressure of less than about 0.7, and the atmosphere of the temperature rising process up to the temperature holding process is adjusted to an atmospheric composition lower than the atmospheric composition of the earlier portion of the temperature holding process, and the atmosphere of a later part of the temperature holding process is adjusted to an atmospheric composition lower than the atmospheric composition of the earlier part of the temperature holding process and in a range from about 0.005 to 0.2.

8 Claims, 1 Drawing Sheet

PROCESS FOR PRODUCING GRAIN ORIENTED SILICON STEEL SHEET, AND DECARBURIZED SHEET

BACKGROUND OF THE INVENTION

1. Field of the Invention

The present invention relates to a process for producing grain oriented silicon steel sheet. In particular, the present invention is directed to a decarburization annealing process for improvement of magnetic characteristics and film characteristics by controlling the physical properties of the surface oxides layer which is formed in the step of decarburization annealing. The invention further relates to a novel silicon controlled sheet that results from the decarburizing step of the process.

2. Description of the Related Art

Grain oriented silicon steel sheets are used as soft magnetic materials mainly for iron cores of transformers and rotating electrical machines. They are required to have high magnetic flux density, small iron loss and small magnetostriction. High magnetic flux density is attained by highly aligning the crystallographic orientation by the process of secondary recrystallization. The aligned structure has the so-called GOSS orientation having a {110} surface in the steel sheet surface and an <001> axis of easy magnetization.

Iron loss includes both eddy current loss and hysteresis loss. Eddy current loss is influenced by the thickness and electrical resistance of the steel sheet and, in addition, by the film tensile force, magnetic domain width and crystal size of the steel sheet. On the other hand, hysteresis loss is influenced by the crystal orientation, purity, strain and surface smoothness. For the purpose of reducing hysteresis loss it is effective in particular to align the crystal orientation in the direction of the axis of easy magnetization. Generally, it is accepted in grain oriented silicon steel sheet to align the crystal orientation by secondary recrystallization to a so-called GOSS orientation of {110} <001>. Magnetostriction is reduced to a small value by alignment of the crystal orientation or by increase of the tensile force of the film.

Hence, it is very important for reduction of iron loss and magnetostriction to enhance the integration of GOSS orientation.

Grain oriented silicon steel sheets are produced from a grain oriented silicon steel slab which contains an inhibitor such as MnS, MnSe or AlN, required for secondary recrystallization. The slab is heated and subjected to hot rolling. Thereafter, annealing is performed as required. One time of cold rolling, or two or more times of cold rolling with intermediate annealing follows. This reduces the sheet thickness to the final value. Next, annealing is performed which functions both for decarburization and first recrystallization. Then an annealing separator comprising MgO or the like as the main component is coated on the steel sheet, which is subjected to high temperature finishing annealing to achieve secondary recrystallization.

The grain orientation inhibitor functions to direct the grain toward the GOSS orientation, selectively inhibiting the growth of grain in other orientations in the primary recrystallization structure. It is therefore indispensable for secondary recrystallization.

Two types of such inhibitors are known. One serves as a fine precipitate; examples of this type include AlN, MnSe and MnS. The other type induces grain boundary segregation; examples of this type include Sb, Sn, Nb and Te. The fine precipitate type is presently mainly used in the production of grain oriented silicon steel sheet. For success with an inhibitor of the fine precipitate type, it is important to disperse uniformly a necessary and sufficient amount in fine size because the inhibitor when dispersed uniformly inhibits the growth of primary recrystallization grain until secondary recrystallization takes place.

Forsterite ($Mg_2SiO_4$) insulation film is often formed on grain oriented silicon steel sheets except in special cases. Formation of forsterite insulation film on grain oriented silicon steel sheets is achieved by cold rolling the sheet to the desired final sheet thickness and subjecting it to continuous annealing under wet hydrogen at a temperature of 700° to 900° C. This annealing functions in the following three ways to promote proper secondary recrystallization:

(1) It causes the deformed structure, after cold rolling, to recrystallize primarily;

(2) It decarburizes the carbon originally present in an amount of 0.01 to 0.1% by weight in the steel sheet to a possible low of not more than 0.003% by weight; and (3) It forms an oxides layer on the surface of the steel sheet, which layer contains $SiO_2$, a precursor of a forsterite film after oxidation, as its main component.

Subsequently to decarburization annealing an annealing separator, mainly MgO, is coated as a slurry on the steel sheet and dried; thereafter, the steel sheet is wound in a form of coil. Finishing annealing is then applied, which functions for both secondary recrystallization annealing and purification annealing. It takes place in a reducing or non-oxidizing atmosphere at a temperature not exceeding 1200° C. or so. The forsterite insulation film is formed mainly by the solid phase reaction $$2MgO+SiO_2 \rightarrow Mg_2SiO_4.$$

MgO is present in the annealing separator and $SiO_2$ is present in the surface oxides layer.

The forsterite film is a thin film ceramic insulator of only several micrometers thickness, and must be very uniform and free of defects. In addition, it should have excellent adhesion to resist the forces of shearing, punching and bending, and should be smooth and have a high space factor when laminated as an iron core.

Furthermore, this forsterite film contributes to improvement of the magnetic characteristics of the sheet for reasons to be explained hereinafter. Hence, it is important to control the process of film formation to obtain excellent film quality.

The forsterite film imparts tensile stress to the steel sheet and effectively improves its iron loss and magnetostriction. Tensile stress occurs since the forsterite film undergoes less thermal expansion than the steel sheet.

The forsterite film absorbs inhibitor components which become unnecessary after completion of secondary recrystallization; this takes place during the step of high temperature annealing. This purifies the steel sheet and provides improved magnetic characteristics.

Furthermore, the formation of the forsterite film influences the inhibitor, such as MnS, MnSe or AlN, in the steel sheet during finishing annealing. Hence, this influences the secondary recrystallization itself, which is an indispensable factor in obtaining excellent magnetic characteristics of the sheet.

Formation of the forsterite film occurs at a temperature in the range of about 900° C. as the temperature rises in finishing annealing. If the forsterite film forming reaction occurs too late or proceeds non-uniformly, or if the formed film is porous, oxygen and nitrogen tend to invade the steel sheet. This causes the inhibitor in the steel sheet to decompose or to turn bulky or excessive.

If the forsterite film forming reaction occurs too quickly and starts at too low a temperature, the inhibitor begins to be absorbed at a low temperature and the amount of inhibitor in the steel sheet becomes insufficient. In this way the structure of secondary recrystallization tends to have low integration of GOSS orientation and poor magnetic characteristics.

The forsterite film is a ceramic film in which fine crystals of about one micrometer size are finely integrated, and is formed on the steel sheet by use of the oxide as one raw material, as mentioned above, formed on the steel sheet surface in decarburization annealing.

The type, amount and distribution of the oxides formed on the surface layer of the steel sheet involve the formation of forsterite nuclei and growth of grains, and influence the strength of the grain boundary and the grains themselves. For example, an excessive amount of oxides formed on the surface layer of the steel sheet tends to cause local peeling of the forsterite film and to make the forsterite grains coarse. Too small an amount of oxides formed on the surface layer of steel sheet tends to form thin and brittle film some parts of which expose the bare base steel. On the other hand, an excessive amount of the oxides makes the forsterite film too thick and causes poor adhesiveness.

Increase of non-magnetic components in the steel sheet reduces the space factor when the sheet is incorporated into iron cores.

The annealing separator, which contains MgO as the main component, is coated on the steel sheet as a slurry suspended in water. Hence, the separator retains $H_2O$ adsorbed physically even after drying. A part of the MgO is hydrated and turns to $Mg(OH)_2$. Release of $H_2O$ therefore continues in the step of finishing annealing up to a temperature of 800° C. or so, although the amount is small. The steel sheet surface is, however, oxidized by the $H_2O$. This oxidation phenomenon is called additional oxidation. If the extent of additional oxidation is considerable the formation rate of forsterite is restricted, and oxidation and decomposition of the inhibitor are increased in the surface layer. The secondary recrystallization grains having GOSS orientation are known to generate the nuclei and grow near the surface layer of the steel sheet. Hence, too much additional oxidation tends to deteriorate both the film characteristics and its magnetic characteristics. Susceptibility to this additional oxidation is significantly influenced by the physical properties of the oxides layer in the steel sheet surface layer that is formed in decarburization annealing.

In a grain oriented silicon steel sheet that incorporates AlN as the inhibitor, the physical properties of the oxide layer of the steel sheet influence the nitrogen removal behavior that occurs during finishing annealing. It can also influence nitrogen invasion behavior into the steel sheet from an annealing atmosphere, and therefore influences the magnetic characteristics of the sheet through the movement of the inhibitor. That is, when the nitrogen removal proceeds, the inhibiting power of the inhibitor is weakened in which case secondary recrystallization will not occur effectively and the magnetic characteristics of the sheet are caused to deteriorate. On the other hand, when nitrogen invasion becomes excessive the inhibitor becomes too strong and secondary recrystallization with good orientation hardly occurs at all.

Accordingly it is important, for the purpose of forming an excellent forsterite insulation film uniformly at a proper temperature, to control the physical properties of the oxides layer formed during decarburization annealing in the surface layer of the steel sheet. When an excellent forsterite insulation film is formed, secondary recrystallization develops under very favorable conditions. Accordingly, formation of an excellent forsterite insulation film is a very important objective in the production technology which governs the product quality of grain oriented silicon steel sheet.

In particular, in the case of thin steel sheets, the influence of the surface becomes relatively strong even in addition to the fact that the region of nuclei of the GOSS orientation becomes narrow. Control of certain physical properties of the steel sheet surface has been found to be very important for the purpose of achieving excellent magnetic characteristics.

Several processes have been proposed for improving film and magnetic characteristics by decarburization annealing of grain oriented silicon steel sheet.

JP-B 58-46547 discloses a process wherein Si, O or a silicon compound containing Si, O and H is adhered before decarburization annealing. JP-A 57-1575 discloses a process wherein the content of atmospheric components expressed as the ratio of the steam partial pressure to the hydrogen partial pressure is not less than 0.15 in the former half step of decarburization, and is not more than 0.75 in the later half step and is lower than the degree of oxidation in the early half step. JP-A 2-240215 and JP-B 54-24686 disclose processes wherein heat treatment is performed at 850° to 1,050° C. in a non-oxidative atmosphere after decarburization annealing.

JP-A 6-336616 discloses a process wherein the content of atmospheric components expressed as the ratio of the steam partial pressure to the hydrogen partial pressure is not more than 0.7 in the decarburization holding step, and the content of atmospheric components expressed as the ratio of the steam partial pressure to the hydrogen partial pressure in the decarburization rising step is lower than that in the decarburization holding step.

However, these professes do not give satisfactory results, although certain effects are recognized. Magnetic characteristics or adhesiveness, or coating properties or uniformity of the film have deteriorated in the width or length direction of particular steel sheet coils. Room still remains for improvement to achieve superior specifications of quality and high yield.

SUMMARY OF THE INVENTION

An object of the present invention is to overcome the problems above discussed and to provide a decarburization annealing process for producing a grain oriented silicon steel sheet having excellent magnetic characteristics and having a film which is uniform, has excellent adhesiveness, and is free from defects over the entire width and entire length of the steel sheet coil product.

The present invention is directed to a process for producing a grain oriented silicon steel sheet wherein a grain oriented silicon steel slab is subjected to hot rolling, subsequently to cold rolling or multiple cold rolling with intermediate annealing, and is subjected to a novel process of decarburization annealing, and thereafter to finishing annealing in which an annealing separator is applied by coating one or a plurality of silicon compounds which essentially comprise Si, O and H, or a silicon compound which essentially comprises Si and O. The silicon compound is adhered preliminarily to the steel sheet surface before decarburization annealing in an amount ranging from about 0.5 to 7.0 mg (expressed as Si) per square meter of one surface of the steel sheet.

Decarburization annealing involves a temperature increase phase followed by a temperature holding phase that includes a preliminary or early stage of treatment followed by a later holding stage. The atmosphere to which the sheet is exposed at an early stage of the temperature holding phase of decarburization annealing is adjusted to maintain a particular steam-to-hydrogen ratio. Adjustment can readily be accomplished by use of independent control valves to control the introduction of steam and hydrogen into the system. The atmospheric composition is expressed as a ratio of the existing steam partial pressure to the existing hydrogen partial pressure. According to this invention, this ratio is maintained in an early decarburization holding phase at a value of less than about 0.7, preferably about 0.4 to 0.7. The atmosphere that exists during a previous temperature rising phase wherein the temperature of the sheet is increased up to the subsequent temperature holding steps is modified to a different atmospheric composition. Also expressed as a ratio of the existing steam partial pressure to the existing hydrogen partial pressure, this ratio in a later stage of temperature holding is lower than the ratio that is used at the early stage of the decarburization annealing temperature holding process. It has a ratio that is sharply lower than the ratio for the early part of the temperature holding process, and is in a range from about 0.005 to 0.2. This is an important and advantageous feature of the invention.

In the present invention, it is further preferable that the oxides layer formed on the steel sheet surface in the step of decarburization annealing is controlled to range from about 0.4 to 2.5 g/m$^2$ expressed as the weight of oxygen per unit area.

DETAILED DESCRIPTION OF THE INVENTION

Figure 1:
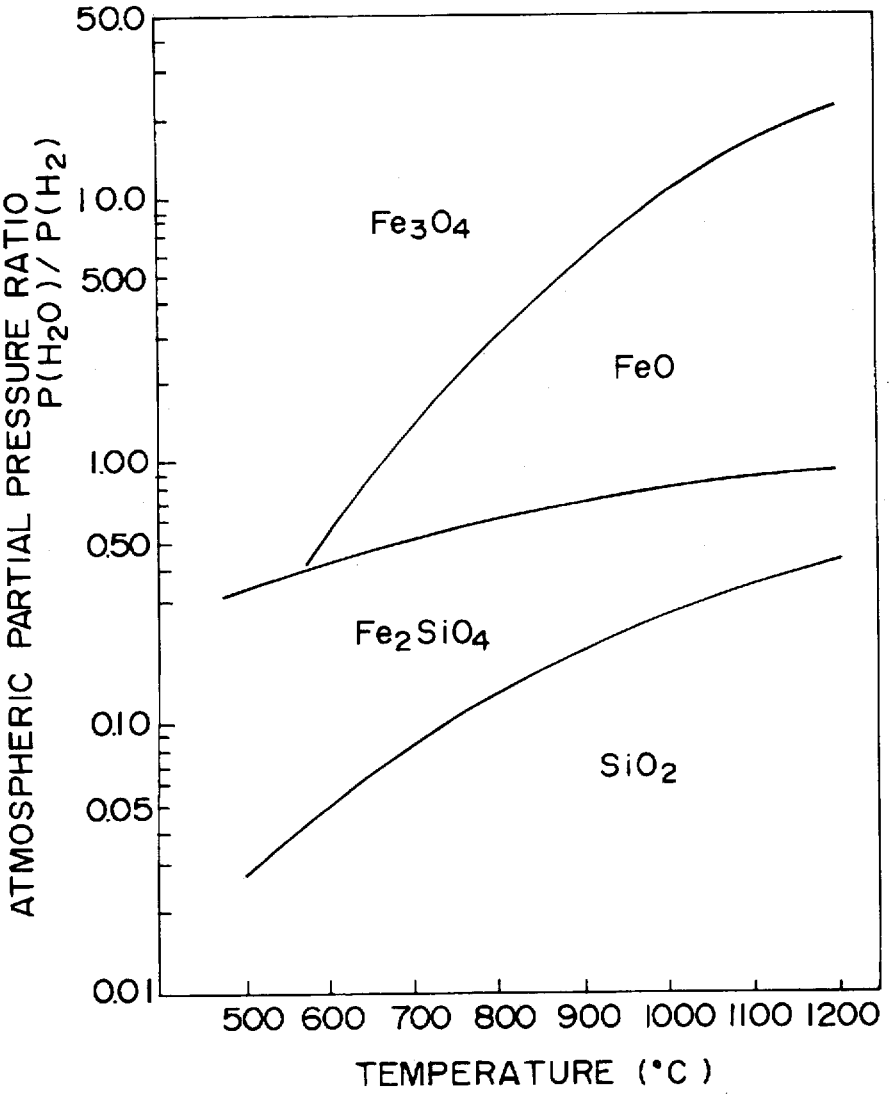
FIG. 1 is an equilibrium diagram of a 3% grain oriented silicon steel sheet surface.

We have found that special decarburization conditions can provide beneficial variation of physical properties of the oxides present or which are formed during decarburization annealing in the surface layer of the steel sheet, and that this influences the quality of the product significantly.

We have found that $SiO_2$, which is an oxide that is present in the steel sheet surface layer formed during decarburization annealing, tends to react undesirably with (hydrated) MgO, which is present in the annealing separator coated on the steel sheet surface. This forms a forsterite film (expressed as $Mg_2SiO_4$) but in the course of this reaction, as disclosed in JP-A 6-192847, additional oxidation occurs under the influence of $H_2O$ contained in the hydrated MgO. This deteriorates the film characteristics and magnetic characteristics of the product.

The same reference also discloses that reduction of chemical activity of the decarburization annealed sheet surface is effective for inhibiting additional oxidation. It mentions that chemical activity can be measured by immersing the steel sheet in an acid under certain conditions and measuring the weight difference before and after immersion, per unit area. This measurement is hereinafter referred to as "pickling weight loss."

We have found that if a decarburization annealed sheet having a pickling weight loss of about 0.35 g/m$^2$ or less is obtained, inhibition of additional oxidation is possible in the next final finishing annealing step.

We have studied how to achieve a decarburization annealed sheet having a small pickling weight loss. In doing this we studied many details regarding not only the decarburization annealing conditions but also pretreatment conditions. Examples of these studies will now be described.

A final cold rolled grain oriented silicon steel sheet of 0.23 mm thickness, which contained MnSe and Sb as the inhibitor and 3.3% by weight of Si, was cleaned in an alkaline degreasing bath, and was subsequently subjected to electrolysis in a 5% aqueous solution of sodium orthosilicate. Si compounds were thereby precipitated on the final cold rolled sheet surface. The amount of adhered Si compounds was examined at three different levels, 0.2 mg/m$^2$, 3.0 mg/m$^2$, and 7.5 mg/m$^2$ respectively, expressed as milligrams of Si. This was done by changing the electrolysis time and the current density used.

Thereafter, decarburization annealing was performed in an atmosphere of a mixed gas comprising $N_2$, $H_2$, and $H_2O$. In this step the atmospheric composition expressed as the ratio of the steam partial pressure to the hydrogen partial pressure [$P(H_2O)/P(H_2)$] was measured in the following ranges: about 0.31 to 0.62 in the temperature rising process; about 0.47 to 0.72 in the early part of the temperature holding step; and about 0.002 to 0.30 in the later part of the temperature holding step. The temperature of annealing and holding was 830° C. and the period of time of annealing and holding was 120 seconds. The residence periods in the atmosphere of the early part of the temperature holding step and in the atmosphere of the later part of the temperature holding step were controlled to 100 seconds and 20 seconds respectively. After this decarburization annealing, the chemical activity of the steel sheet surface was evaluated by determining the pickling weight loss of the sheet when pickling in 5% HCl at 70° C. for 60 seconds. Further, the amount of oxides present was evaluated as the weight of oxygen (expressed as O) per unit area (hereinafter referred to as marked oxygen value). The results are shown in Table 1.

TABLE 1

| | | Atmospheric P ($H_2O$)/P($H_2$) | | | | |
|---|---|---|---|---|---|---|
| Test No. | Adhered Si amount before annealing mg/m$^2$ | Temp. rising process | Early part of temp. holding process | Later part of temp. holding process | Marked oxygen value g/m$^2$ | Pickling weight loss g/m$^2$ |
| 1 | 0.2 | 0.45 | 0.55 | 0.04 | 1.1 | 0.65 |
| 2 | " | 0.38 | 0.47 | 0.01 | 0.9 | 0.72 |
| 3 | " | 0.31 | 0.62 | 0.10 | 1.2 | 0.77 |
| 4 | 3.0 | 0.45 | 0.55 | 0.04 | 1.6 | 0.20 |
| 5 | " | 0.38 | 0.47 | 0.01 | 1.4 | 0.17 |
| 6 | " | 0.31 | 0.62 | 0.10 | 2.0 | 0.25 |
| 7 | " | 0.55 | 0.55 | 0.04 | 1.2 | 0.39 |
| 8 | " | 0.62 | 0.55 | 0.04 | 1.3 | 0.43 |
| 9 | " | 0.45 | 0.72 | 0.04 | 2.2 | 0.60 |
| 10 | " | 0.45 | 0.55 | 0.30 | 1.5 | 0.45 |
| 11 | " | 0.45 | 0.55 | 0.002 | 1.4 | 0.58 |
| 12 | 7.5 | 0.45 | 0.55 | 0.04 | 0.3 | 0.81 |
| 13 | " | 0.38 | 0.47 | 0.01 | 0.3 | 0.95 |
| 14 | " | 0.31 | 0.62 | 0.10 | 0.5 | 0.73 |

In Table 1, when the amount of adhered Si before annealing was as small as 0.2 mg/m$^2$, the marked oxygen value was small and the pickling weight loss was high.

Tests Nos. 12–14 used an amount of Si as large as 7.5 mg/m$^2$; the marked oxygen value was smallest of all and the pickling weight loss was very high.

In contrast, Tests Nos. 4–6 were cases where the amount of Si was 3.0 mg/m$^2$; $P(H_2O)/P(H_2)$ in the early part of temperature holding process was 0.47–0.62; $P(H_2O)/P(H_2)$ in the temperature rising process was lower than the early holding step; and $P(H_2O)/P(H_2)$ was 0.01–0.10 in the later holding step. As compared to Tests Nos. 12–14, the marked oxygen value increased, the pickling weight loss sharply decreased.

In Tests Nos. 7 and 8, the $P(H_2O)/P(H_2)$ values in the temperature rising process were the same as or higher than those in the early part of the temperature holding process; the pickling weight loss was higher than Tests Nos. 4–6.

In Test No. 9 the $P(H_2O)/P(H_2)$ value in the early part of the temperature holding process was as high as 0.72. In Tests Nos. 10 and 11, $P(H_2O)/P(H_2)$ in the later part of the temperature holding process was 0.3 or 0.002; in both cases, the pickling weight loss was quite high.

We have found, therefore, that the pickling weight loss was extremely low in the cases of Tests 4–6, in the range of about 0.17 to 0.25, wherein the Si compound was adhered to the steel sheet surface before the decarburization annealing in an amount ranging from about 0.5 to 7.0 mg per square meter of a surface of the steel sheet, expressed as the weight of Si; the atmosphere of the early part of the temperature holding process had a ratio of steam partial pressure to hydrogen partial pressure $[P(H_2O)/P(H_2)]$ of less than about 0.7; the atmosphere at the later part of the temperature holding process was in a range from about 0.005 to 0.2; and the atmosphere of the temperature rising step up to the temperature holding step was lower than the atmospheric composition of the early part of the temperature holding process. Furthermore, the magnetic characteristics were very stable and excellent for the steel sheet produced by Tests Nos. 4–6.

It is known that physical properties of the oxides layer formed during decarburization annealing in the surface layer of steel sheet substantially depend on the physical properties of the oxide formed at the initial stage. We believe that adhesion of Si compound before decarburization annealing and control of the atmospheric composition in the temperature rising process lower than the temperature holding process make the pickling weight loss decrease. We believe this is because change of configuration or composition of the oxides formed at the initial stage makes oxygen easily able to diffuse in the steel. Thereby, the oxides layer becomes finer. On the other hand, too much adhesion of the Si compound brings about conditions in which the surface oxides retard the diffusion of oxygen during the temperature holding process; thereby, the marked oxygen value is reduced and the surface protectiveness accordingly deteriorates. Too high an atmospheric composition ratio $P(H_2O)/P(H_2)$ in the temperature rising process tends to cause too rapid oxidation; thereby formation of a fine surface oxides layer is restricted and the surface protectiveness of the layer deteriorates as well.

The deterioration of pickling weight loss in the temperature holding process when $P(H_2O)/P(H_2)$ is 0.7 and higher involves the formation of FeO, judging from FIG. 1, which shows an equilibrium of 3% grain oriented silicon steel sheet surface. In addition, the decrease of pickling weight loss when the ratio $P(H_2O)/P(H_2)$ was 0.04–0.10 is understood to have occurred because the oxides in the topmost surface layer were reduced to conditions of lower chemical activity in which $SiO_2$ is the main component.

Another factor found to be important is the adhesion of Si compounds to the steel sheet surface before decarburization annealing. As shown in JP-B 58-46457 mentioned before, adhesion of an Si compound to a steel sheet surface before annealing is known to cause increased oxidation during decarburization annealing to cause inhibition of FeO formation, and to cause promotion of $Fe_2SiO_4$ formation. In addition to the adhesion of a Si compound to steel sheet surface before annealing, the present invention is also based on our discoveries as exemplified in Table 1. Additional independent control of the atmospheric composition during the temperature rising process, during the initial or early part of the temperature holding process, and during the later part of the temperature holding process, respectively, have been discovered to provide very excellent and beneficial phenomena.

Various Si compounds can be adhered to the steel sheet. A silicon compound essentially comprising Si, O and H or essentially comprising Si and O, or as represented by the formula $SiO_2.xH_2O$, is effective. Examples of such compounds include orthosilicic acid ($H_4SiO_4$), metasilicic acid ($H_2SiO_3$), water-soluble ultra-fine particle $SiO_2$ such as colloidal silica, $SiO_2$ formed by electrodeposition when a steel sheet is subjected to electrolysis in an aqueous solution of alkali silicate. These compounds can contain combined water.

The amount of such Si compound adhered to the sheet is important. If it is less than about 0.5 $mg/m^2$ expressed as Si it tends not to give an optimum effect. An amount exceeding about 7 $mg/m^2$ expressed as Si makes the marked oxygen value decrease sharply because of formation on the surface of a fine film through which oxygen only difficultly penetrates.

Decarburization deteriorates as the marked oxygen value decreases. Poor decarburization in a grain oriented silicon steel sheet influences the magnetic characteristics very adversely. For these reasons, the upper limit of the adhered amount of Si compound is specified to be about 7 $mg/m^2$ (expressed as Si). A more preferable range is about 0.7 through 6.0 $mg/m^2$.

The method of adhering the Si compound to the surface of the steel sheet includes either coating or electrolysis.

When the coating method is selected, the grain oriented silicon steel sheet after final cold rolling should be subjected to preliminary surface degreasing so that the coating solution will not be repelled and so that the surface has good wettability. Examples of suitable coating agents include colloidal silica of about 4 to 50 μm particle size, and silicic acid ($SiO_2.xH_2O$) although the latter has poor solubility in water.

There is no particular limitation regarding the means for coating, or regarding components or concentration after coating. For example, by use of a coating roll which has grooves cut at a distance of about 0.5 through 2.0 mm, the amount of coating may be optionally controlled by selection of the coating liquid concentration and the roller pressure.

When electrolysis treatment is selected, the grain oriented silicon steel sheet is subjected to cleaning to remove rolling oil and iron dust adhered to the surface after final cold rolling, and to remove scale particles formed during various processes prior to the final cold rolling.

Examples of cleaning treatments include immersion degreasing, spray degreasing, blushing degreasing and so-called electrolytic degreasing in which the steel sheet is electrolytically processed in an alkaline degreasing bath. An aqueous solution containing one or more of sodium hydroxide, sodium carbonate, sodium phosphate, and sodium silicate is normally used as a degreasing bath in electrolytic degreasing. When a degreasing bath which contains a silicate solution is used, compounds including silica or silicate, or compounds including silica or silicate and hydrated oxide compounds of iron are electrodeposited on the steel surface. This phenomenon is remarkable on cathode plates in particular.

It is very advantageous to subject a grain oriented silicon steel sheet after final cold rolling to electrolytic degreasing in a degreasing bath containing a silicate or to provide electrodes for electrolysis at the later step of immersion degreasing, because adhesion of a silicon compound, a requirement in the present invention, can be realized simultaneously with the degreasing treatment. This procedure is also advantageous in that adhesion of the silicon compound can be optionally selected by controlling the quantity of electricity.

Examples of silicates that are usable as the electrolysis bath include sodium silicates such as sodium orthosilicate ($Na_4SiO_4$), sodium metasilicate ($Na_2SiO_3$) and water glass which is a liquid mixture of various sodium silicates. It is also possible to use silicates of potassium and lithium. In either case, the molar ratio of the metallic ion to silicon is optional.

Composition of the electrolysis bath may contain other components such as NaOH and $Na_2CO_3$ at optional concentrations as long as the above silicate compound is present. However, the preferable concentration of the silicate is about 0.5 to 5%, since important objects of the invention can be attained with respect to both degreasing and Si adhesion. Furthermore, the electrodeposition of an Si compound is also possible by subjecting the steel sheet to electrolysis treatment in a colloidal silica suspension.

Method steps and conditions of the electrolysis treatment are not limited in particular, with considerable leeway available as to type of current application, current density, and duration and temperature. Any known practical electrolytic methods and conditions may be selected.

The compounds formed on the steel sheet surface in decarburization annealing include FeO and oxides of Mn and Al, in addition to $SiO_2$ and silicates such as $Fe_2SiO_4$ and $Fe_2SiO_3$. Among them, FeO and $Fe_2O_4$ are chemically active compounds; decarburization annealing which might produce these compounds in a large amount should be avoided. For this purpose, the atmospheric composition $P(H_2O)/P(H_2)$ of the decarburization annealing atmosphere should be less than about 0.70.

Also, it is favorable that the atmospheric composition in the earlier part of the temperature holding process is more than about 0.2 to assure sufficient decarburization.

On the other hand, $SiO_2$ and $Fe_2SiO_3$ are chemically less active materials. Large amounts of them formed on the surface will reduce the pickling weight loss of the sheet. For the purpose of forming a large amount of $SiO_2$ on the steel sheet surface, it is effective to create an $SiO_2$ formation zone during the later part of the temperature holding process of decarburization annealing by lowering the atmospheric composition ratio $P(H_2O)/P(H_2)$ to not more than about 0.2. However, too much decrease of atmospheric composition ratio $P(H_2O)/P(H_2)$ makes the pickling weight loss increase; the lower limit of the atmospheric composition in the later part of the temperature holding process should be about 0.005.

For the purpose of forming $Fe_2SiO_3$ in a large amount, it is effective to keep the atmospheric composition of the atmosphere in the temperature rising step of the process lower than the atmospheric composition in the temperature holding step.

The chemical activity of the surface layer is influenced significantly not only by the kinds of oxide in the oxide layer but also by the conditions of the oxide layer, such as size and shape of the oxide particle, oxide distribution pattern and oxide layer structure. The oxide layer conditions are delicately affected by the combination of the annealing conditions such as annealing temperature, annealing period of time and atmospheric composition. For example, when the atmospheric composition ratio $P(H_2O)/P(H_2)$ is not more than about 0.5, the pickling weight loss decreases as the annealing period is longer. However, in the case where the atmospheric composition ratio $P(H_2O)/P(H_2)$ is slightly higher, for example, about 0.55, the longer annealing period increases the pickling weight loss, although the oxide formation is not so affected. Hence, annealing conditions other than the atmospheric composition should be considered in view of these facts.

The oxide layer of the steel sheet after decarburization annealing is preferred to have a marked oxygen value ranging from about 0.4 to 2.5 $g/m^2$. A marked oxygen value less than about 0.4 $g/m^2$ makes the subscale fineness poor; thereby, protectiveness of the surface deteriorates. A marked oxygen value more than about 5 $g/m^2$ affects the subscale whereby the film characteristics and magnetic characteristics are adversely affected.

Turning now to the compositions for the grain oriented silicon steel sheet according to the present invention, a suitable range of Si is about 2.0 to 5.0% by weight and Mn about 0.03 to 0.30% by weight.

Carbon is necessary to improve the hot rolled structure; however excess carbon causes decarburization difficulties. The suitable carbon content range is from about 0.02 to 0.12% by weight.

Insufficient silicon yields low electrical resistance and does not give good iron loss characteristics; on the other hand, excess silicon causes difficulty in cold rolling.

Manganese is necessary as an inhibitor component; however, excess manganese makes the inhibitor grains coarse. The suitable manganese content range is from about 0.03 to 0.30% by weight.

Inhibitors of the MnSe types, MnS types, AlN types, AlN—MnS types, may be used in the steel according to the present invention. Inhibitors of the AlN—MnS types and AlN—MnSe types are suitable because they give high magnetic flux density.

Sulfur and/or selenium are inhibitor components; however a content of sulfur and/or selenium exceeding about 0.05% by weight causes difficulty in refining of finishing annealing; on the other hand, a content less than about 0.01% by weight is an insufficient inhibitor amount. The total content of silicon and selenium should be from about 0.01 to 0.05% by weight.

When AlN is used as the inhibitor, an insufficient amount of the aluminum induces poor orientation of the secondary recrystallized particle and gives low magnetic flux density; however, excess aluminum induces unstable secondary recrystallization. The preferable aluminum content is from about 0.01 to 0.05% by weight.

Nitrogen in an amount of less than about 0.004% by weight gives insufficient AlN, and more than about 0.012% by weight causes blisters on the product. The nitrogen content is specified as from about 0.004 to 0.012% by weight.

It is also effective for the improvement of magnetic characteristics of a steel sheet to utilize the segregation effect of antimony on the steel sheet surface and suppress oxidation of the inhibitors by addition of antinomy.

Copper is effective to improve the magnetic characteristics because it not only has the effect of decreasing the pickling weight loss but also improves inhibitor efficiency.

In addition, tin tends to decrease particle size of secondary recrystallization and therefore to improve iron loss.

Hence, it is possible to improve the magnetic characteristics of the product by incorporating at least one of Sb, Cu and Sn. In this case, a content of less than about 0.01% by weight does not give an appreciable effect; on the other hand, a content of more than about 0.3% by weight brings an adverse effect to the brittleness of the film; the preferable content is from about 0.01 to 0.30% by weight.

In addition to these elements, an element which reinforces various functions of inhibition, such as Nb, Te, Cr, Bi, B, and Ge can be properly added.

Furthermore, it is possible to add Mo for preventing surface defects caused by hot brittleness.

Turning to the production process, a slab or ingot of the silicon steel of the above mentioned composition is shaped into a required size and subjected to hot rolling by heating. The hot rolled sheet is subjected to annealing under temperature holding conditions, for example at a temperature from about 900° to 1200° C., then quenched, and subsequently subjected to one time of cold rolling or two or more times of cold rolling between which times intermediate annealing is performed. In the case of an AlN type inhibitor, it is advantageous to perform the cold rolling with not less than about 80% of final draft; with the draft of less than about 80%, a primary recrystallization structure which promotes the development of the strong inhibiting power of AlN cannot be obtained. The steel sheet after the final cold rolling is subjected to degreasing and pickling for cleaning the surface, and is thereafter subjected to decarburization annealing under the above mentioned conditions.

The decarburization annealing temperature may be from about 700° to 900° C., which is the normal temperature for decarburization and primary recrystallization. The period of time of annealing is controlled so that the prescribed range of marked oxygen value can be realized.

After annealing for decarburization and primary recrystallization, a separator containing MgO as the main component is coated on the steel sheet, which is wound into a coil and subjected to final finishing annealing. The final finishing annealing comprises a temperature holding process at a temperature from about 1100° to 1200° C., in which step purification is performed. The secondary recrystallization occurs during the temperature rising step up to the temperature holding step, or in the temperature holding step done in the course of temperature rising as required. Subsequently, insulating coating is applied as required to the steel sheet. Thereby, the product is obtained.

The following examples are illustrative of the invention. They are not intended to define or to limit the scope of the invention, which is defined in the appended claims.

EXAMPLE 1

A grain oriented silicon steel slab containing 0.068% by weight of C, 3.32% by weight of Si, 0.074% by weight of Mn, 0.023% by weight of Se, 0.024% by weight of sol. Al, 0.0080% by weight of N, and 0.023% by weight of Sb was subjected to hot rolling into a thickness of 2.3 mm, then subjected to a normalizing annealing at 1000° C., and further subjected to two times of cold rolling between which times an intermediate annealing at 1100° C. was done; thereby, the product thickness was 0.23 mm.

The silicon steel sheet was then immersed and degreased in an alkaline solution of a commercial degreasing agent, and then electrolyzed in a 3% aqueous sodium orthosilicate solution; thereby Si compounds were precipitated on the sheet surface. By changing the quantity of electricity for the electrolysis treatment, the amount of adhered Si compounds was varied to the values shown in Table 2; the values were for Si compounds converted to elemental Si and so reported. The quantity of adhered silicon was determined by fluorescent X-ray analysis with a calibration curve prepared beforehand.

The sheet was then subjected to decarburization annealing in a mixed gas atmosphere comprising $H_2$, $N_2$ and $H_2O$, beginning by holding the temperature at 840° C. for 130 seconds. In the course of this decarburization annealing step, the atmospheric compositions in the temperature rising process, the early part of the temperature holding process (110 seconds), and the later part of the temperature holding process (20 seconds) were controlled independently, and the $P(H_2O)/P(H_2)$ ratios for each step were adjusted to the values shown in Table 2. An annealing separator slurry of MgO containing 5% of $TiO_2$ was coated on the sheet and was dried. The sheet was then subjected to final finishing annealing for 10 hours at 1200° C. in an atmosphere of $H_2$. The sheet was then coated with a composition chiefly comprising magnesium phosphate and colloidal silica.

Specimens were sampled from the product thus obtained at 200-meter intervals along the length of the steel sheet coils, and the magnetic flux density ($B_8$ value) at a magnetic field of 800 A/m, the iron loss ($W_{17/50}$) at 1.7 T and 50 Hz, and the flexural adhesiveness of the coating were determined. The flexural adhesiveness shown was the minimum diameter of the rod with which the coating was not separated, when the specimens were wound around rods of various diameters with 5 mm intervals. Appearance of the coating was visually evaluated all over the surface, along the length and the width directions, by the color tone and by noting any inhomogeneity such as coating defect. The marked oxygen value of the steel sheet after decarburization annealing was also determined. Table 2 shows the results that were obtained.

TABLE 2

| Test No. | Adhered Si amount before annealing mg/m² | Atmospheric Ratio $P(H_2O)/P(H_2)$: Temperature rising process | Temperature process: Early part | Temperature process: Later part | Marked oxygen value (g/m²) | Product characteristics: Magnetic $B_8$ (T) | $W_{17/50}$ (W/kg) | $W_{17/50}$ σ | Film: Adhesiveness(mm) | Film: Appearance | Note |
|---|---|---|---|---|---|---|---|---|---|---|---|
| 15 | 0.8 | 0.30 | 0.45 | 0.02 | 1.2 | 1.954 | 0.80 | 0.024 | 15 | Even | Example |
| 16 | 2 | 0.45 | 0.60 | 0.01 | 1.5 | 1.950 | 0.81 | 0.017 | 10 | " | " |
| 17 | 2 | 0.20 | 0.50 | 0.08 | 1.4 | 1.955 | 0.81 | 0.020 | 10 | " | " |
| 18 | 4 | 0.35 | 0.55 | 0.04 | 1.7 | 1.953 | 0.78 | 0.013 | 10 | " | " |
| 19 | 4 | 0.40 | 0.60 | 0.15 | 1.6 | 1.952 | 0.79 | 0.018 | 10 | " | " |
| 20 | 6 | 0.30 | 0.47 | 0.06 | 1.8 | 1.953 | 0.80 | 0.016 | 15 | " | " |
| 21 | 0 | 0.35 | 0.55 | 0.04 | 0.9 | 1.921 | 0.90 | 0.086 | 30 | Uneven | Comparative Ex. |
| 22 | 0.2 | 0.45 | 0.60 | 0.01 | 1.1 | 1.928 | 0.91 | 0.067 | 30 | " | " |
| 23 | 2 | 0.60 | 0.60 | 0.01 | 1.2 | 1.931 | 0.89 | 0.053 | 35 | " | " |
| 24 | 2 | 0.20 | 0.75 | 0.08 | 1.7 | 1.919 | 0.90 | 0.065 | 30 | " | " |
| 25 | 4 | 0.40 | 0.60 | 0.001 | 1.5 | 1.924 | 0.93 | 0.072 | 40 | " | " |
| 26 | 8 | 0.40 | 0.60 | 0.15 | 0.3 | 1.903 | 0.97 | 0.088 | 50 | " | " |

Ex.: Example according to the present invention
Comp. Ex.: Comparative Example
σ: Standard deviation As seen from Table 2, the samples from Tests Nos. 15 through 20, which are examples according to the present invention, provide excellent magnetic characteristics and film characteristics. The variation of iron loss was small enough to be excellent as evidenced by the standard deviation. The pickling weight loss, which is not shown in the table, was also small enough, and was 0.35 g/m² or less in all cases.

To the contrary, the samples from Tests Nos. 21 through 26, which are comparative examples not according to the present invention, are poor in both magnetic and film characteristics and have large variations: Samples Nos. 21 and 22 had a silicon adhesion less than 0.5 mg/m²; No. 23 had the same $P(H_2O)/P(H_2)$ in the temperature rising process as in the early part of temperature holding process; No. 24 had a $P(H_2O)/P(H_2)$ of higher than 0.70 in the early part of temperature holding process; No. 25 had a $P(H_2O)/P(H_2)$ less than 0.005 in the early part of temperature holding process; and No. 26 had a silicon adhesion of more than 7 mg/m² and had a marked oxygen value of less than 0.4 g/m².

EXAMPLE 2

A grain oriented silicon steel slab containing 0.046% by weight of C, 3.30% by weight of Si, 0.062% by weight of Mn, 0.020% by weight of Se, 0.024% by weight of sol.Al, 0.0080% by weight of N, and 0.021% by weight of Sb was subjected to hot rolling into a thickness of 2.0 mm, then subjected to a normalizing annealing at 900° C., and further subjected to two times of cold rolling between which times an intermediate annealing at 980° C. was done; thereby, the thickness of finally cold rolled sheet was 0.23 mm. The silicon steel sheet was then immersed and degreased in an alkaline solution of a commercial degreasing agent, washed with water, and dried. Then, by use of a coating roll, the sheet was coated with colloidal silica so that the adhered amount, reported as Si, were the values shown in Table 3. The sheet was dried. The quantity of coated colloidal silica on the surface was controlled by the concentration of the colloidal silica and the draft of the coating roll.

Then, the sheet was subjected to decarburization annealing in a mixed gas atmosphere comprising $H_2$, $N_2$ and $H_2O$, holding the temperature at 830° C. for 120 seconds. In the course of this decarburization annealing process, the atmospheric compositions in the temperature rising process, the early part of the temperature holding process (100 seconds), and the latter part of the temperature holding process (20 seconds) were controlled independently, and the $P(H_2O)/P(H_2)$ ratios were adjusted to the values shown in Table 3. Then, an annealing separator slurry of MgO containing 1% of TiO and 2% of $SrSO_4$ was coated on the sheet and was dried. The sheet was then subjected to a final finishing annealing in an $H_2$ atmosphere. The final finishing annealing comprised two steps: the first step was a secondary recrystallization annealing at 850° C. for 50 hours; and the second step was purification annealing subsequently in $H_2$ atmosphere at 1180° C. for 7 hours. The subsequent procedures and the evaluations were the same as in Example 1. Table 3 shows the results.

TABLE 3

| Test No. | Adhered Si amount before annealing mg/m² | Atmospheric Ratio $P(H_2O)/P(H_2)$: Temperature rising process | Temperature process: Early part | Temperature process: Later part | Marked oxygen value (g/m²) | Product characteristics: Magnetic: $B_8$ (T) | $W_{17/50}$ (W/kg) | $W_{17/50}$ σ | Film: Adhesiveness(mm) | Appearance | Note |
|---|---|---|---|---|---|---|---|---|---|---|---|
| 27 | 1 | 0.25 | 0.45 | 0.01 | 1.8 | 1.923 | 0.81 | 0.018 | 10 | Even | Example |
| 28 | 1 | 0.15 | 0.40 | 0.10 | 1.5 | 1.922 | 0.81 | 0.016 | 10 | " | " |
| 29 | 3 | 0.25 | 0.45 | 0.02 | 1.7 | 1.924 | 0.82 | 0.021 | 10 | " | " |
| 30 | 3 | 0.40 | 0.60 | 0.06 | 1.6 | 1.925 | 0.81 | 0.018 | 10 | " | " |
| 31 | 5 | 0.30 | 0.55 | 0.04 | 2.0 | 1.921 | 0.80 | 0.013 | 10 | " | " |
| 32 | 5 | 0.40 | 0.58 | 9.04 | 1.9 | 1.922 | 0.80 | 0.015 | 15 | " | " |
| 33 | 1 | 0.25 | 0.45 | 0.50 | 1.7 | 1.907 | 0.89 | 0.058 | 30 | Uneven | Comparative Ex. |
| 34 | 3 | 0.25 | 0.45 | 0.25 | 1.6 | 1.904 | 0.90 | 0.067 | 35 | " | " |
| 35 | 5 | 0.60 | 0.55 | 0.04 | 1.5 | 1.902 | 0.91 | 0.083 | 25 | " | " |

As seen from Table 3, the samples Nos. 27 through 32, which are examples according to the present invention, are excellent in magnetic characteristics and film characteristics. The pickling weight loss, which is not shown in the table, was small enough, 0.35 g/m² or less in all of samples Nos. 27 through 32.

To the contrary, the samples Nos. 33 through 35, which are comparative examples not according to the present invention, are poor in both magnetic and film characteristics: Test Nos. 33 and 34 had $P(H_2O)/P(H_2)$ ratios of higher than 0.2 in the later part of the temperature holding process; and Test No. 35 had a higher $P(H_2O)/P(H_2)$ ratio in the temperature rising process than in the temperature holding process.

EXAMPLE 3

A grain oriented silicon steel slab containing 0.030% by weight of C, 3.10% by weight of Si, 0.062% by weight of Mn, and 0.021% by weight of S was subjected to hot rolling into a thickness of 3 mm, then subjected to normalizing annealing at 970° C. for 5 minutes, and further subjected to two times of cold rolling between which times an intermediate annealing at 900° C. was done; thereby, the thickness of the finally cold rolled sheet was made 0.30 mm. The silicon steel sheet was then immersed and degreased in an alkaline solution of a commercial degreasing agent, and then electrolyzed in a 3% aqueous sodium orthosilicate solution; thereby, Si compounds were precipitated on the surface. By changing the quantity of electricity supplied in the electrolysis treatment, the amount of adhered Si compounds was varied as the values shown in Table 4; the values for Si compounds were converted to the quantity of Si and so reported.

Then, the sheet was subjected to decarburization annealing in a mixed gas atmosphere comprising $H_2$, $N_2$ and $H_2O$, holding the temperature at 830° C. for 140 seconds. In the course of this decarburization annealing process, the atmospheric compositions in the temperature rising process, the early part of the temperature holding process (120 seconds), and the latter part of the temperature holding process (20 seconds) were controlled independently, and the $P(H_2O)/P(H_2)$ ratios were adjusted to the values shown in Table 4. The oxide formed in the decarburization annealing on the surface were determined by chemical analysis, and were evaluated as the marked oxygen value. Then, an annealing separator, in a slurry, of MgO containing 2% of $MgSO_4$ was coated, dried, wound into a coil, and then subjected to final finishing annealing. The final finishing annealing was performed in an $H_2$ atmosphere at 1180° C. for 5 hours. The subsequent procedures and the evaluations were the same as in Example 1. Table 4 shows the results that were obtained.

TABLE 4

| Test No. | Adhered Si amount before annealing mg/m² | Atmospheric Ratio $P(H_2O)/P(H_2)$: Temperature rising process | Temperature process: Early part | Temperature process: Later part | Marked oxygen value (g/m²) | Product characteristics: Magnetic: $B_8$ (T) | $W_{17/50}$ (W/kg) | $W_{17/50}$ σ | Film: Adhesiveness(mm) | Appearance | Note |
|---|---|---|---|---|---|---|---|---|---|---|---|
| 36 | 2.5 | 0.30 | 0.60 | 0.03 | 1.8 | 1.870 | 1.14 | 0.025 | 20 | Even | Example |
| 37 | 2.5 | 0.20 | 0.48 | 0.01 | 1.6 | 1.86g | 1.12 | 0.022 | 25 | " | " |
| 38 | 5.5 | 0.40 | 0.55 | 0.03 | 2.2 | 1.874 | 1.13 | 0.026 | 20 | " | " |
| 39 | 5.5 | 0.15 | 0.40 | 0.07 | 2.0 | 1.872 | 1.10 | 0.020 | 25 | " | " |
| 40 | 2.5 | 0.65 | 0.60 | 0.002 | 1.7 | 1.851 | 1.31 | 0.105 | 40 | Uneven | Comparative Ex. |
| 41 | 5.5 | 0.20 | 0.75 | 0.04 | 2.6 | 1.849 | 1.29 | 0.093 | 40 | " | " |
| 42 | 7.5 | 0.40 | 0.80 | 0.03 | 0.5 | 1.838 | 1.25 | 0.089 | 45 | " | " |

As seen from Table 4, the samples Nos. 36 through 39, which are examples according to the present invention, had excellent magnetic characteristics and film characteristics. The pickling weight loss, which is not shown in the table, was small enough, 0.35 g/m² or less in all the cases of samples 36–39.

To the contrary, samples Nos. 40 through 42, which are comparative examples not according to the present invention, had poor magnetic and film characteristics: sample No. 40 had a $P(H_2O)/P(H_2)$ ratio in the temperature rising process higher than the temperature holding process and had a $P(H_2O)/P(H_2)$ ratio less than 0.005 in the later part of temperature holding process; No. 41 had a $P(H_2O)/P(H_2)$ ratio higher than 0.7 in the early part of temperature rising process and had a marked oxygen value of more than 2.5 $g/m^2$; and No. 42 had a $P(H_2O)/P(H_2)$ ratio higher than 0.7 in the early part of temperature holding process.

As explained, according to the present invention, a process for producing a grain oriented silicon steel sheet stably is provided having excellent magnetic characteristic and film characteristic. At the same time, the present invention provides grain oriented silicon steel sheets having uniform magnetic characteristics along the width and length directions of the steel sheet coil and with uniform film characteristics.

What is claimed is:

1. In a process for producing a grain oriented silicon steel sheet wherein a grain oriented silicon steel slab is subjected to hot rolling, subsequently subjected to cold rolling, then subjected to decarburization annealing, and thereafter subjected to finishing annealing, the steps which comprise:

prior to said decarburization annealing step, adhering a silicon compound to said steel sheet, said silicon compound essentially comprising Si, O and H or Si and O, said silicon compound being applied to the surface of said steel sheet in an amount of about 0.5 to 7.0 mg per square meter, expressed as weight of Si;

performing decarburization annealing in an atmosphere containing steam and hydrogen and in at least three successive steps a temperature rising step, a successive earlier decarburization holding step and a later decarburization holding step while adjusting said atmosphere in each said step to an atmospheric composition, expressed as the atmosphere ratio of the steam partial pressure to the hydrogen partial pressure, adjusting said atmosphere ratio in said earlier decarburization holding step to less than about 0.7; and adjusting said atmosphere ratio in said later decarburization holding step and in said temperature rising step to values lower than said atmosphere ratio in said earlier decarburization holding step.

2. The process defined in claim 1 wherein said atmosphere ratio in said later decarburization holding step is in a range from about 0.005 to 0.2.

3. The process defined in claim 1 wherein an oxides layer is formed on said steel sheet surface by decarburization annealing, and is provided in an amount of about 0.4 to 2.5 $g/m^2$ expressed as elemental oxygen.

4. The process defined in claim 1 wherein said atmosphere ratio in said earlier portion of said decarburization annealing step is about 0.2 to 0.7.

5. The process defined in claim 1 wherein said earlier decarburization annealing step is conducted over a time of about 100 to 120 seconds and at an atmosphere ratio of about 0.2 to 0.7, and wherein said later decarburization annealing step is conducted over a time of about 20 seconds and at an atmosphere ratio of about 0.005 to 0.2.

6. The process defined in claim 1 wherein said decarburization annealing step is conducted at a decarburization annealing temperature of about 700° C.–900° C.

7. The process defined in claim 1 wherein said atmosphere ratio in said temperature rising step is less than said atmosphere ratio in said earlier decarburization holding step but is much greater than said atmosphere ratio in said later decarburization holding step.

8. The process defined in claim 1 wherein said atmosphere ratio is about 0.31 to 0.62 in said temperature rising process, about 0.47 to 0.72 in said earlier part of said temperature holding step, and about 0.002 to 0.30 in said later part of said temperature holding step.

* * * * *

UNITED STATES PATENT AND TRADEMARK OFFICE

CERTIFICATE OF CORRECTION

PATENT NO. : 5,725,681

DATED : March 10, 1998

INVENTOR(S) : Hirotake Ishitobi, et al

It is certified that error appears in the above-indentified patent and that said Letters Patent is hereby corrected as shown below:

In column 4, at line 36, please change "professes" to --processes--; and

In column 15, at table 4, test no. 37, at subheading "(T)", please change "1.86g" to --1.869--.

Signed and Sealed this

Fifteenth Day of December, 1998

Bruce Lehman

*Attest:*

BRUCE LEHMAN

*Attesting Officer*

*Commissioner of Patents and Trademarks*